United States Patent [19]

Soares

[11] Patent Number: 4,614,523

[45] Date of Patent: Sep. 30, 1986

[54] GRAVITY GASIFIER FOR REDUCING FREE TARS AND IMPROVING EFFICIENCY

[75] Inventor: Adelino H. F. Soares, Sao Paulo, Brazil

[73] Assignee: Voith S.A. Maquinas E Equipamentos, Brazil

[21] Appl. No.: 689,670

[22] Filed: Jan. 8, 1985

[30] Foreign Application Priority Data

Jan. 9, 1984 [BR] Brazil ..... MU 6400043

[51] Int. Cl.[4] ..... C10J 3/68

[52] U.S. Cl. ..... 48/76; 48/67; 122/158; 122/160

[58] Field of Search ..... 48/62 R, 76, 77, 63, 48/64, 67, 68, 203; 110/234; 122/152, 158, 160, 166 R; 422/200, 201

[56] References Cited

U.S. PATENT DOCUMENTS

| | | | |
|---|---|---|---|
| 3,087,253 | 4/1963 | Wulf | 34/10 |
| 3,311,460 | 3/1967 | Stotler et al. | 48/197 R |
| 4,344,772 | 8/1982 | Pillard | 48/76 |

*Primary Examiner*—Donald Czaja
*Assistant Examiner*—Jennifer Cabaniss
*Attorney, Agent, or Firm*—Ostrolenk, Faber, Gerb & Soffen

[57] ABSTRACT

A downflow, gravity type gasifier includes a vertically oriented chamber having a loading zone at the top, followed by a drying zone, followed by a pyrolytic zone for pyrolytic decomposition, followed by a cracking zone for cracking the tars, followed by a reduction zone and an oxidation zone wherein the gas is generated and the combustible material is burned. The cracking zone has a divider, e.g. a cruciform divider, in it, and each of the resulting sections of the cracking zone is individually supplied with air for more uniform distribution of air and more uniform cracking than heretofore available. In addition to the air supplied to the periphery at the cracking zone, air outlets are arranged in respective radial arrays of the outlets for more uniform distribution of air into the reduction and oxidation zone. Steam is generated in the cooling water jacket surrounding the oxidation zone and that steam is delivered into and passed through the interior of a cruciform-shaped radiator disposed in the drying zone for heating the drying zone. The air from the arrays of air outlets creates an additional oxidation zone performing additional oxidation, so as to deliver substantially tar-free gas from the gas outlet of the gasifier.

16 Claims, 10 Drawing Figures

GRAVITY GASIFIER FOR REDUCING FREE TARS AND IMPROVING EFFICIENCY

BACKGROUND OF THE INVENTION

The invention relates to a gas generator, and specifically a gasifier which gasifies combustible or carbonizable solid materials, and more particularly to a gravity type gasifier wherein the combustible materials to be gasified move through a loading zone at the top of the gasifier, and pass successively through a drying zone, a pyrolyzing zone, a cracking zone where the tars are cracked, a reduction zone where the gas is generated and an oxidation zone. The starting materials include waste wood and biomass, for example. Both charcoal and combustible gas are obtained in this process. With such gasifiers, there are the objectives of reducing the need for energy to heat the combustible material in the drying chamber, of maximizing cracking of the tars for reducing the quantity of tars released in the processing, and of improving the inflow of oxidizing air. There are numerous gasifiers and various techniques are known for achieving the foregoing goals. An example of such a gasifier is shown in U.S. Pat. No. 4,344,772.

In conventional downflow, gravity type gasifiers, there is a natural limitation in the internal cross-section of the reaction chamber. Once that natural limitation in cross-section is exceeded, the cracking process becomes uncontrollable and excessive tar is generated. The invention is designed to reduce the generated tars.

There is an external cooling jacket especially located at the lower part of the gasifier. Steam is generated there in abundant quantities. A large part of the steam is utilized in the combustible gas generation process. One of the objectives of the invention is to make use of that steam to heat the combustible material drying chamber located toward the top of the apparatus.

Finally, the oxidation air is typically introduced about the periphery of the thermo-chemical reactor. One of the objectives of the invention is to improve the delivery of air and make a more uniform oxidation zone so that the combustible material being degasified is more uniformly treated and the process is improved.

SUMMARY OF THE INVENTION

A downflow gravity type gasifier according to the invention achieves the first objective of permitting enlargement of the internal cross-section of the reaction chamber while maintaining control over the cracking process. The portion of the gasifier chamber at the pyrolyzing zone and above the reactor thermo-chemical reduction zone defines a cracking zone for the tars. It is divided into a plurality of smaller sized chambers. In one instance, the cracking zone is divided into two, equal chambers. In another instance, a plurality of arcuate segment chambers, especially in a circular cracking zone, are provided. Because of the plurality of smaller cross-section chambers, oxidizing air which is injected into the cracking zone is distributed in a more uniform manner, providing better cracking of tars. The dividers between the adjacent chambers in the cracking zone may be metallic structures, and cooling water may circulate internally in the dividers. In some situations, the dividers may be provided with a covering of protective refractory material.

A jacket filling with cooling water surrounds the lower part of the thermo-chemical reactor around the reduction zone and the lower oxidation zone. A radiator for utilizing the excessive steam formed in the external cooling jacket is disposed in the combustible material drying chamber for improving the drying.

Furthermore, oxidation air is typically introduced about the periphery of the reactor. In order to improve oxidation, it is desirable to deliver the oxidizing air not only about the periphery but into the center of the reactor which creates a more uniform oxidation zone in the material being oxidized.

BRIEF DESCRIPTION OF THE DRAWINGS

Other objects and features of the invention will become apparent from the following description of a preferred embodiment of the invention considered in conjunction with the accompanying drawings in which.

DESCRIPTION OF THE PREFERRED EMBODIMENTS

Figure 1:
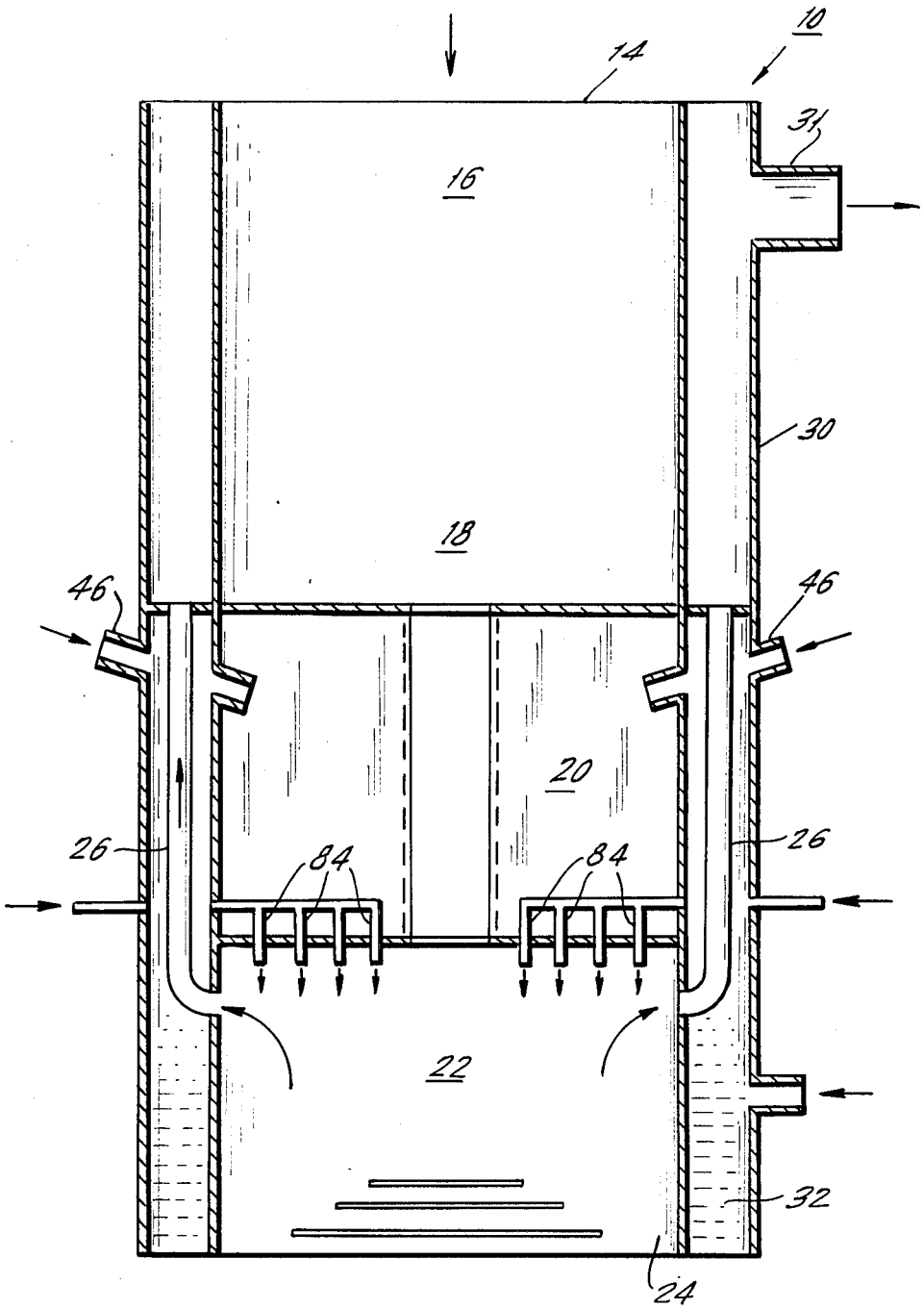
FIG. 1 is a side cross-sectional view of a gasifier including the features of the present invention.

The gravity type downflow gasifier 10 according to the present invention is shown schematically in FIG. 1. The gasifier essentially comprises a hollow, vertically oriented cylindrical chamber into the top of which combustible material is deposited. The combustible material passes through a number of zones and chambers discussed below which gasify the material and produce a combustible gas and which then oxidizes and eliminates the remaining combustible material.

The gasifier has a combustible material loading zone 14 at the top end. Below the loading zone, the gasifier chamber includes the drying zone 16 in which the material to be gasified is dried for removal of included water and liquid.

Following their downward movement under gravity from the drying zone, the combustible materials are decomposed by pyrolysis in the pyrolytic zone 18. The pyrolytic zone 18 includes a cracking zone 20 which cracks the tars that have developed during pyrolyizing and the tars that also would be developed during the subsequent thermo-chemical reduction and oxidation stages. The reduction zone 22 followed by the oxidation zone 24 subject the materials to a controlled combustion which leads to production of charcoal from the materials or subsequently in the oxidation zone to total combustion producing ash. The oxidation zone 24 is a high temperature zone, of course, and further cracking of tars takes place in the oxidation zone. The reduction zone 22 is beneath the cracking zone 20. The oxidation zone 24 is beneath the reduction zone 22. Combustible gas is generated in the reduction zone and in the oxidation zone and that gas exits from the reduction zone 22 through the plurality of exit pipes 26 which extend upwardly through the surrounding jacket 30 of the apparatus and eventually exit through the the gas exit 31 located adjacent the drying zone.

The cooling jacket 30 as is conventional surrounds the reduction zone and the oxidation zone for cooling those zones as the cooling jacket 30 is filled with water in its cooling chamber 32. Considerable steam is generated and use of that steam during the drying process is described below. Ash that is generated in the oxidation zone and/or charcoal that is produced is removed at the bottom of the oxidation zone 24.

Figure 2:
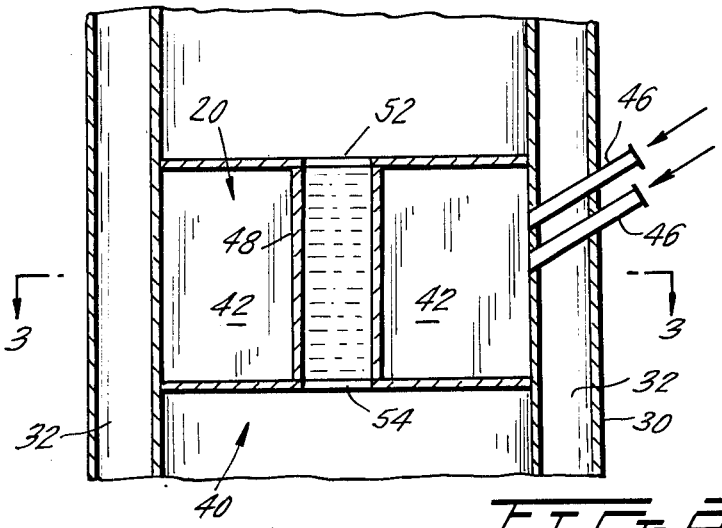
FIG. 2 is a fragmentary view of the gasifier showing the tar cracking zone.
Figure 3:
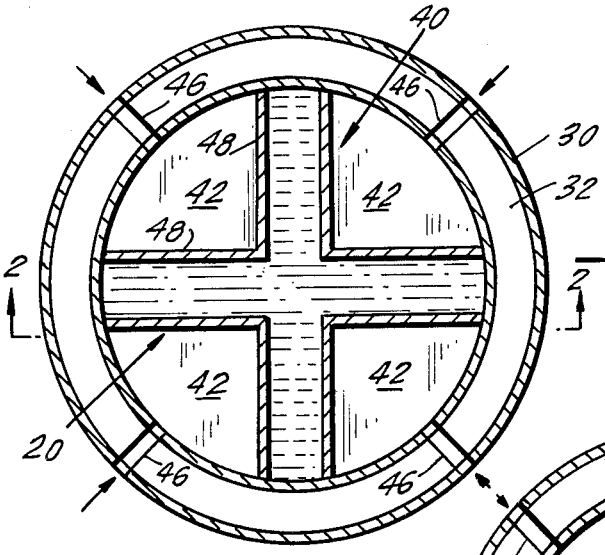
FIG. 3 is a top view of the tar cracking zone, in the direction of arrows 3 in FIG. 2, and showing one embodiment of the cracking zone.
Figure 4:
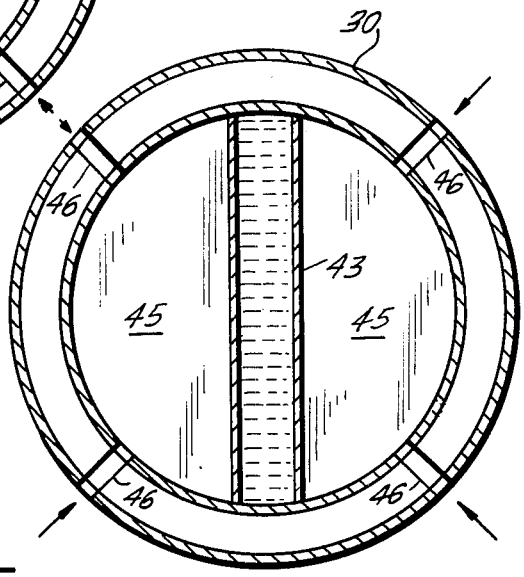
FIG. 4 is a top view of a second embodiment of a cracking zone.

With reference to FIGS. 2 and 3, the first embodiment of the cracking zone 20 comprises a cruciform divider unit 40, which divides the internal chamber of the gasifier in the cracking zone 20 into four separate arcuate segments, namely radial sections 42. The number of sections 42 is a matter of choice depending on the size of the gasifier and the design of the divider unit 40. For example, in FIG. 4, the divider 43 is a flat sided panel which bisects the cracking zone into two semicircular sections 45. The plurality of sections has the effect of more uniformly distributing the oxidizing air that is injected into the cracking zone through the inlets, like inlets 46. It is noted from FIG. 3 that the air is delivered to all of the sections 42. The more uniform distribution of the oxidizing air over the whole cross-section of the chamber provides more uniform temperature throughout the sections 42 in the cracking zone. The cracking zone 20 efficiently cracks the tars that are formed due to the simple injection of oxidizing air into the individual sections of this zone, and the quantity of tars produced is reduced.

The divider unit 40 is comprised of metallic, steel walls 48 of preselectable height. As a result, individual sections 42 can be chosen of different heights. The metallic walls of the divider unit are closed at their top and bottom ends 52, 54 for defining an enclosure for containing circulating water between the walls 48. The sections 42 are open at their tops and bottoms for free passage therealong of the material to be gasified.

Figure 5:
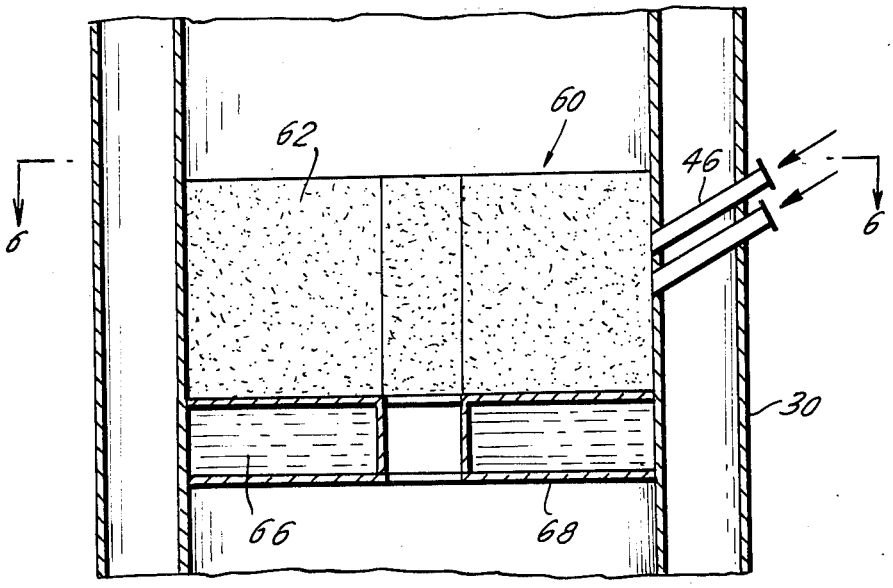
FIG. 5 is the same type of view as FIG. 2 and showing a third embodiment of the cracking zone.
Figure 6:
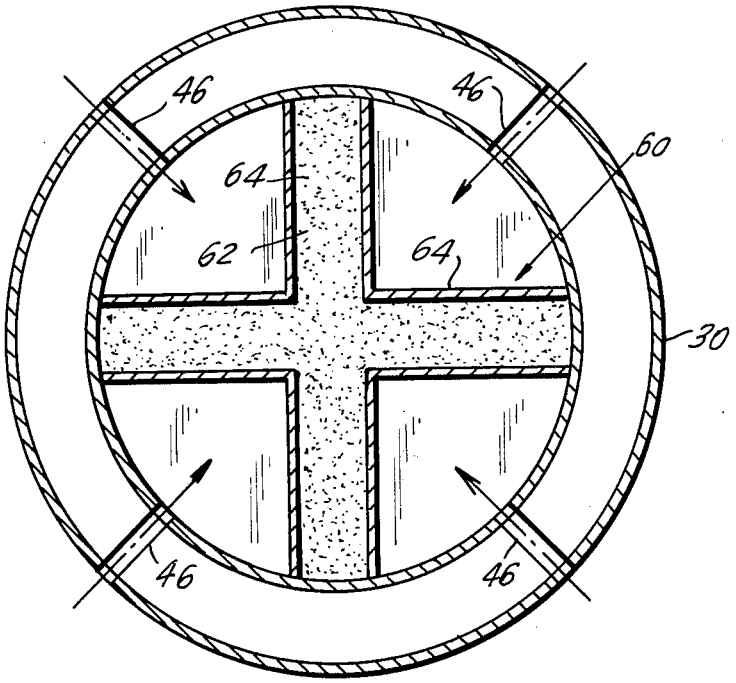
FIG. 6 is a top view of FIG. 5 in the direction of arrows 6 in FIG. 5.

An alternate version of the divider unit 60 in FIGS. 5 and 6 is clad with a refractory, fireproof, protective material at 62 on its walls 64 at the upper portion of the divider unit 60. The walls still define a water circulation chamber 66 below and behind the refractory material. The circulating cooling water in the chamber 66 cools the divider unit while the refractory material 62 provides heat protection.

Figure 7:
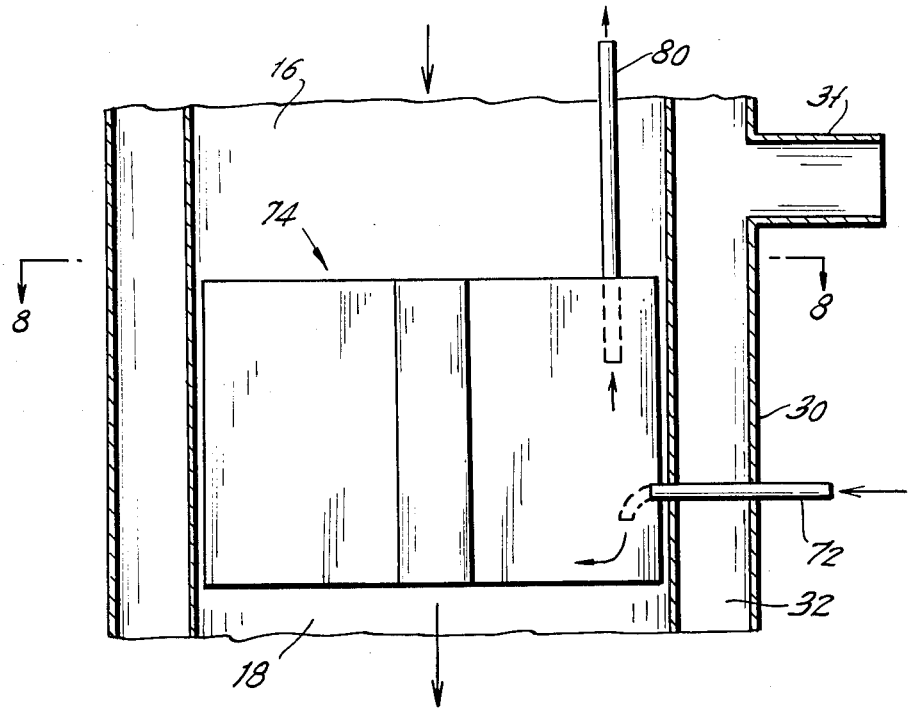
FIG. 7 is a side view of the cracking zone showing the use of steam for improving combustible material drying in the drying zone.
Figure 8:
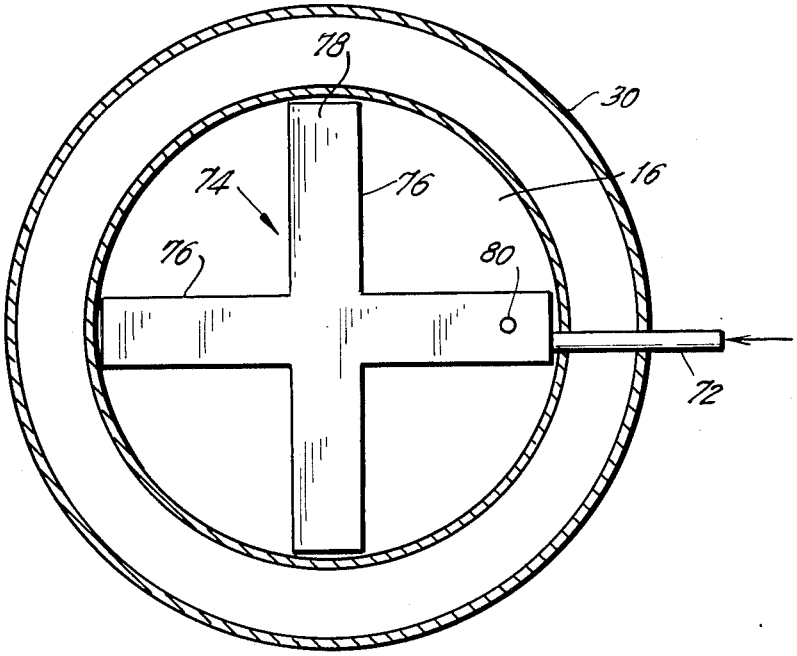
FIG. 8 is a top view of the cracking zone in the embodiment shown in FIG. 7 along the lines 8—8 in FIG. 7.

With reference to FIGS. 7 and 8, a large part of the steam produced around the reduction and oxidation zones is utilized in the combustible gas generation process. Excess steam that is formed in this cooling jacket 30 is delivered through the inlet 72 into the interior of a cruciform-shaped radiator 74 that is disposed inside the drying zone above the pyrolyzing zone. This cruciform-shaped radiator is similar in shape to the abovedescribed cracking zone divider unit 40, but is a separate unit. The radiator is a hollow metallic structure and its cruciform shape was chosen because of its plurality of fins 76, which improves heat radiation. The inletted steam fills the chamber 78 in all of the radiator fins 76 and heat is radiated into the drying zone. From the radiator 74 there is an outlet conduit 80 out of which steam and the condensates from the radiator is carried. The additional radiator in the drying zone improves the operating efficiency of the gasifier. The narrow thickness, but radius width fins 76 do not interfere with the downward passage of the combustible materials as they pass through the drying zone into the pyrolyzing zone.

With reference to FIGS. 1–3, 9 and 10, air is fed to the gasifier through the peripheral air inlets 46 and into the individual sections 42 from the periphery of the gasifier. That air also circulates downwardly to the reduction and the oxidation zones.

Figure 9:
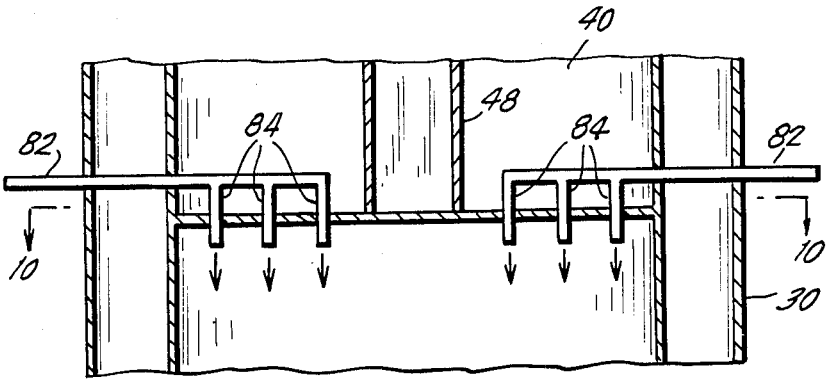
FIG. 9 is a view of the bottom of the cracking zone and the top of the reduction zone, at the pyrolyzing zone.
Figure 10:
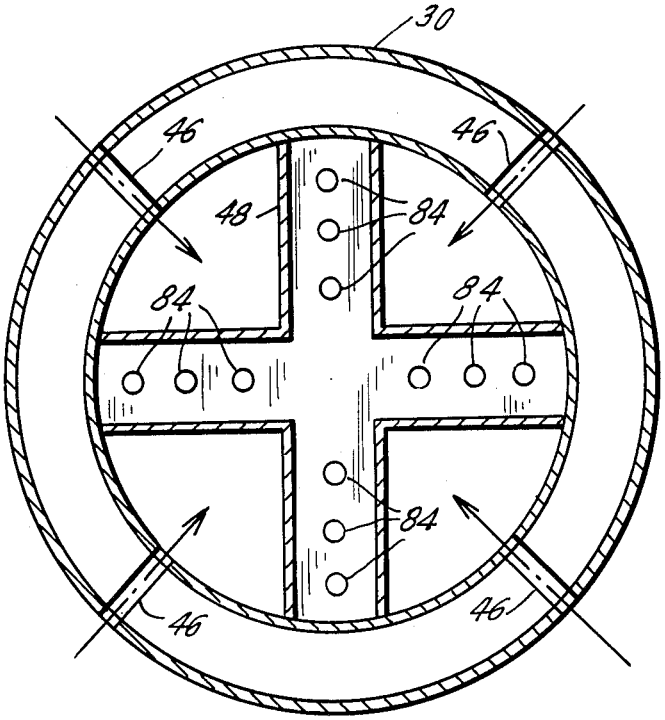
FIG. 10 is a view in the direction of and along the line of arrows 10 in FIG. 9.

More uniform delivery and circulation of air is achieved, according to the embodiment shown in FIGS. 9 and 10, by also introducing air through the center of the reactor. This is achieved by air conduits 82 which pass through the cooling jacket, extend into the interior of the circulating water chamber defined by the divider unit walls 48 and exit through appropriate conduits 84 down into the reduction zone below the cracking zone. The conduits 84 are dispersed along the parts of the divider and thereby deliver the air downwardly into and centrally of the reduction and oxidation zones for more uniform distribution of air and improved thermo-chemical reduction and oxidation. The creation of a uniform oxidation zone in the combustible layer enables it to be transformed into charcoal more efficiently, improving in the process efficiency.

With all or selected ones of the above improvements in the design of a downflow, gravity type gasifier, the efficiency of gas production is improved.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. A downflow, gravity type gasifier comprising a continuous chamber having a vertical axis enabling the continuous downward flow of combustible materials, the chamber having a top end and a bottom end; from the top end to the bottom end; the gasifier chamber comprising: (A) a combustible material loading zone where the materials to be gasified are loaded; (B) a drying zone at which the materials are dried; (C) a pyrolyzing zone at which the materials are decomposed for subsequent reduction and oxidation; (D) a cracking zone for cracking tars which includes a lower part of the pyrolyzing zone; (E) a reduction zone at which gas is generated provided with a gas outlet from the chamber for the gas generated in the reduction and first oxidation zones; and (F) a first oxidation zone at which some gas is generated and the materials are oxidized;

dividing means for dividing the cracking zone into a plurality of sections of smaller cross-section than the entire chamber, each section having spaced apart top and bottom ends which are open for enabling materials to pass through all the sections from the pyrolyzing zone to the reduction zone; air inlet means for supplying air to all the sections defined by the dividing means in the cracking zone;

air delivery means for delivering air to a lower part of each section of the cracking zone, and dowstream therefrom into the reduction zone therebeneath; to create a second oxidation zone directly below and downstream from the cracking zone for performing additional oxidation, so as to deliver substantially tar-free gas from said gas outlet;

further comprising a jacket around the exterior of the oxidation zone for being filled with cooling water and the jacket being so exposed to the chamber at the oxidation zone that the water in the jacket is heated and steam is generated in the jacket; heating means in the drying zone for, in turn, radiating heat in the drying zone; a steam conduit connection from the cooling water jacket at the oxidation zone to the heat radiating means for delivering steam to the radiating means for heating the radiating means which then heats the drying zone.

2. The gasifier of claim 1, wherein the air inlet means comprises a respective inlet extending from the exterior of the gasifier directly to each section of the cracking zone.

3. The gasifier of claim 2, wherein the dividing means is shaped for defining a plurality of the sections, each section having a width in the radial direction of the chamber which is less than the entire diameter of the chamber and which extends to the periphery of the chamber and having a length around the periphery of the chamber which is less than the entire periphery of the chamber.

4. The gasifier of claim 3, wherein the dividing means forms each of the sections generally in the shape of a sector of the chamber.

5. The gasifier of claim 4, wherein the dividing means is shaped for defining at least two of the sectors.

6. The gasifier of claim 5, wherein the dividing means is shaped for defining four of the sectors.

7. The gasifier of claim 4, wherein the dividing means is hollow within itself for defining a dividing means chamber within itself, and the dividing means chamber being, at least in part, filled with circulating cooling liquid.

8. The gasifier of claim 7, wherein the dividing means is, at least in part, covered with a refractory material.

9. The gasifier of claim 1, wherein the air delivery means to the sections of the cracking zone is positioned for delivering air from the periphery of the chamber into the cracking zone sections;

additional means for delivering air downwardly into the reduction zone and toward the oxidation zone from below the cracking zone and those means being disposed across the cross-section of the chamber for delivering air more uniformly across the chamber.

10. The gasifier of claim 9, wherein the means for delivering air to the reduction zone comprises a plurality of conduits directed to exit downwardly into the reduction zone and being in a plurality of arrays arranged radially across the chamber from the periphery thereof toward the center thereof.

11. The gasifier of claim 10, wherein the dividing means is shaped for defining four branches, defining a respective section between adjacent branches; each of the branches of the dividing means extends radially of the chamber; a respective array of the air conduits is arrayed along each of a plurality of the branches defining the dividing means.

12. The gasifier of claim 2, wherein the air delivery means to the sections of the cracking zone is positioned for delivering air from the periphery of the chamber into the cracking zone sections;

additional means for delivering air downwardly into the reduction zone and toward the oxidation zone from below the cracking zone and those means being disposed across the cross-section of the chamber for delivering air more uniformly across the chamber.

13. A downflow, gravity type gasifier comprising a continuous chamber having a vertical axis enabling the continuous downward flow of combustible materials, the chamber having a top end and a bottom end; from the top end to the bottom end, the gasifier chamber comprising a combustible material loading zone where the materials to be gasified are loaded, a drying zone at which the materials are dried, a pyrolyzing zone at which the materials are decomposed for subsequent reduction and oxidation, a cracking zone which includes a lower part of the pyrolyzing zone for cracking tars in the chamber, a reduction zone at which gas is generated, and an oxidation zone at which some gas is generated and the materials are oxidized;

a gas outlet from the chamber being provided near the reduction zone for gas generated in the reduction and oxidation zones; and further comprising a jacket around the exterior of the oxidation zone for being filled with cooling water and the jacket being so exposed to the chamber at the oxidation zone that the water in the jacket is heated and steam is generated in the jacket;

means in the drying zone for being heated and for, in turn, radiating heat in the drying zone; and a steam conduit connection from the cooling water jacket at the oxidation zone to the heat radiating means for delivering steam to the radiating means for heating the radiating means, the heat radiating means being for heating the drying zone.

14. The gasifier of claim 13, wherein the radiating means comprises a radiator in the drying chamber and the radiator is hollow within; the steam conduit connection from the cooling water jacket delivers steam into the interior of the radiator for the steam within the radiator to heat the radiator for radiation; a steam and condensate outlet from the interior of the radiator to the exterior of the gasifier.

15. The gasifier of claim 14, wherein the radiator is generally cruciform shaped.

16. The gasifier of claim 15, wherein the radiator is defined by side walls of metal for improving radiation.

* * * * *